US007168195B1

(12) United States Patent
Seidel

(10) Patent No.: US 7,168,195 B1
(45) Date of Patent: Jan. 30, 2007

(54) SCROLL ADVERTISING DEVICE

(75) Inventor: Gregg A. Seidel, Manhattan Beach, CA (US)

(73) Assignee: Ad-Tech, LLC, El Segundo, CA (US)

( * ) Notice: Subject to any disclaimer, the term of this patent is extended or adjusted under 35 U.S.C. 154(b) by 709 days.

(21) Appl. No.: 10/199,891

(22) Filed: Jul. 19, 2002

(51) Int. Cl.
*G09F 11/18* (2006.01)

(52) U.S. Cl. ..... 40/517; 40/514

(58) Field of Classification Search ..... 40/514, 40/515, 516, 517, 27; 160/23.1, 313, 315, 160/323.1
See application file for complete search history.

(56) References Cited

U.S. PATENT DOCUMENTS 1,701,601 A * 2/1929 Young ..... 40/27
4,346,749 A * 8/1982 Singletary et al. ..... 160/301
4,731,905 A * 3/1988 Milano et al. ..... 16/306
5,097,611 A * 3/1992 Smollar et al. ..... 40/514
5,271,446 A * 12/1993 Hwang ..... 160/23.1
6,038,800 A 3/2000 Seidel
6,557,280 B2 * 5/2003 Seidel ..... 40/455
6,644,606 B1 * 11/2003 Seidel ..... 248/220.41

* cited by examiner

*Primary Examiner*—Lesley D. Morris
(74) *Attorney, Agent, or Firm*—Jack C. Munro

(57) ABSTRACT

A scroll advertising display device which utilizes a housing which includes a windup mechanism which is attached to a sheet member with the sheet member to be extendable from the housing and then retractable by the windup mechanism to be confined in conjunction with the housing. The housing includes a spindle on which the sheet member is wound. The spindle includes a pair of projections which are to engage in conjunction with a windup spring. The body of the spindle is formed as a pair of separate parts which are mated together with the exception at each end of the spindle is located a smaller diametered rod which is integral and formed as a single unit. A material dispenser may be connected in conjunction with the housing with the material dispenser adapted to dispense material, such as a scented gas, coupons, recipes or entry forms.

6 Claims, 5 Drawing Sheets

SCROLL ADVERTISING DEVICE

BACKGROUND OF THE INVENTION

1. Field of the Invention

The field of this invention relates to display apparatuses and more particularly to an advertising information display which is to be mounted on an exterior structure, such as the front edge of a products supporting shelf within a store.

2. Description of the Related Art

Scroll type of advertising devices have long been known. An example of such an advertising device is described within U.S. Pat. No. 6,038,800 which was obtained by the present inventor. Reference is to be had to this patent for a more complete discussion of prior art type of advertising devices.

Typical self service retail stores, such as drug stores, supermarkets, computer software stores, liquor stores and the like, have rows of multiple tier shelves which are to be used to support products for sale. The product, or the exterior package of the product, is visually displayed on the shelf. Generally, there are many units of a particular product stocked on that shelf. The consumer will normally select a product from the shelf without the assistance of a clerk. Therefore, the shelf also performs a dispensing function.

It is common for product manufacturers and distributors to want to include an advertisement or product information display at their shelf location for a particular product. While product is readily visible on shelf, the mere presence of the product, because the product is displayed with numerous other products on the shelf, may be insufficient to stimulate consumer interest. Shelf space in stores is a valuable commodity. The amount of shelf space assigned to each product is at a minimum. A given product can become "lost" on a shelf amongst all the other products. Also, the product may be enclosed in a small package so that there is no large "advertising" surface to catch the consumer's eye or the available space on the package may be insufficient to contain all the information that a manufacturer or retailer wishes to impart to a potential purchaser. Additionally, the product may be packaged in a plain wrapping or, in the case of produce, no packaging at all. There may be involved some kind of specialty promotion with a product that is not included on the package since the promotion may only run for a short period of time. In-store advertisements can also appear on other store pictures and free standing displays.

Manufacturers and retailers are becoming aware that advertising can be an exceedingly effective way in which to sell goods. Not only can the advertising motivate a consumer's purchase, but it can also be informative as to the consumer about the product. Shelf advertising is limited as to available space. The only convenient location for shelf advertising is at the edge of the shelf and can be limited by the size or the product packaging as well. The shelf edge is generally only one inch to one inch and one half in height. However, if some form of device could be mounted on the edge of the shelf, fixture or display and the device constructed in a manner to be expandable to a larger area so that additional information can be printed on the larger area and then made available to the consumer only when the consumer is interested in obtaining that information, then such an advertising device would be most desirable. Also, when the consumer is not utilizing the device, the device assumes a retracted state occupying a minimal amount of space when it is not used.

In the past, it has been known to mount a scroll type of device on the front end of a shelf where the scroll can be unwound to display advertising or information about a product, and then when released by the consumer, the device retracts to a small size, at-rest position. However, in the past, such scroll types of devices have been constructed to become complex and not being capable of being manufactured at a relatively inexpensive cost which is inherently necessary in order for widespread usage of such devices. Another problem with former scroll devices is that such visually blocked the price channel without including a space for the retailer to price inventor or bar code label. Modern stores rely on these labels for price, manage inventory and reordering stock. Additionally, the scroll type devices of the prior art have not been easily mountable on the front end of modern shelving requiring the use of an unattractive and rather large size C-type of clamping device that is used to clamp onto the shelf. It would be far more desirable to have such an advertising device which can be quickly and easily attached and detached to a product shelf, fixture or display without utilizing of bulky in size and unattractive clamping devices specifically, attach the advertising device to the price channel of modern retail shelving.

In the past, another way to include advertising at the point-of-purchase location on the shelf is to mount a freestanding sign which extends outward from the shelf. However, such freestanding signs protrude into the aisle area which is used for the passage of the consumers with the result that such signs are frequently struck by the consumers and knocked free from the shelf therefor becoming ineffective. Also, the usage of such freestanding signs generally obscures the shelves making it somewhat difficult to the consumer to visually find a particular product that the consumer wishes to purchase. Also, such freestanding signs have to be quite small in size therefore being very limited as to the amount of information or advertising that could be placed thereon.

At times, when using a scroll type of advertising device, it may be desirable to include some type of a material dispenser in conjunction with the device. Previously, such a material dispenser has not been known in conjunction with scroll type of advertising devices.

Scroll type of advertising devices that use an extendable sheet material member, which when released will retract to a retracted position within a housing, may experience substantial usage over a short period of time. This substantial usage can result in failure of the advertising device unless the advertising device is constructed in a manner to withstand this heavy usage.

SUMMARY OF THE INVENTION

A first main embodiment of scroll advertising device which utilizes a housing having a windup mechanism. A sheet member is connected to the windup mechanism. The sheet member is extendable from the housing and the sheet member is also retractable to be substantially confined within the housing. Advertising indicia and/or product information is to be located on the sheet member. A material dispenser is to be associated with the housing. The material dispenser adapted to dispense material by activation by a human.

A further embodiment of the present invention is where the first basic embodiment is modified by the dispensing material comprising a scented fluid.

A further embodiment of the present invention is where the first basic embodiment is modified by the material that is dispensed comprises pieces of paper.

A second main embodiment of the present invention comprises a scroll advertising display device which utilizes a housing that has an internal chamber. Mounted within the internal chamber is a spindle. An inner end of a sheet member is attached to the spindle with a pull handle being attached to the outer end of the sheet member. A windup spring is located within the internal chamber of the housing. The sheet member is to be wound on the spindle compressing of the windup spring which exerts a bias onto the spindle tending to locate the sheet member in a tightly wound position with the pull handle located directly adjacent the housing. Movement of the sheet member in an outward direction from the housing causes extension of the sheet member and upon release of same will be retracted into the housing with the pull handle located directly adjacent the housing. The spindle has a first pair of projections formed in a spaced apart arrangement forming a gap therebetween. The windup spring terminates at each end in a hook with a hook to be located within this gap.

A further embodiment of the present invention is where the second basic embodiment is modified by the spindle having a second pair of projections located in a spaced apart arrangement also forming a gap therebetween. A second windup spring may be associated with the second pair of projections.

A further embodiment of the present invention is where the second basic embodiment is modified by the inner end of the sheet member including a reinforcing member in order to strengthen the sheet member in order to withstand extended period of time of constant usage without breaking.

A third main embodiment of the present invention is where there is utilized a housing which has an internal chamber and within that internal chamber is rotatably mounted a spindle. A windup spring is associated with the internal chamber with the windup spring connecting to the spindle. A sheet member is mounted in conjunction with the spindle and the windup spring is to be capable of locating the sheet member in a retracted position with the sheet member being manually extendable from the housing against the bias of the spring when desired by the human user. The spindle is defined as being formed of a cylindrical body terminating at each end in a smaller diameter rod. Each rod is integral and functions as a retainer for the windup spring. Also, each rod is journaled in an end cap which is mounted on the housing.

A further embodiment of the present invention is where the third basic embodiment is modified by the spindle having a pair of projections located in a spaced apart arrangement forming a gap therebetween. A windup spring terminates at each end in a hook. This hook is to be located within this gap.

A further embodiment of the present invention comprises a fourth main embodiment of scroll type of advertising display device where a housing has a spindle. The spindle is rotatably mounted on the housing. The spindle has a pair of projections located in a closely spaced apart arrangement forming a gap therebetween. A windup spring connects between the housing and the spindle. The windup spring terminates at one end in a hook with this hook connecting with the gap. The windup spring exerts a continuous bias on the spindle.

A further embodiment of the present invention is where there is a fifth embodiment comprising a scroll type of advertising display device which has a housing which includes a spindle with this spindle being rotatably mounted on the housing. The spindle is defined as being formed of a cylindrical body terminating at each end in a smaller diameter rod. Each rod being integral and forming a solid unit and functions as a retainer for a windup spring. Also, each rod is journaled in an end cap which is mounted on the housing.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figures 1, 1A:
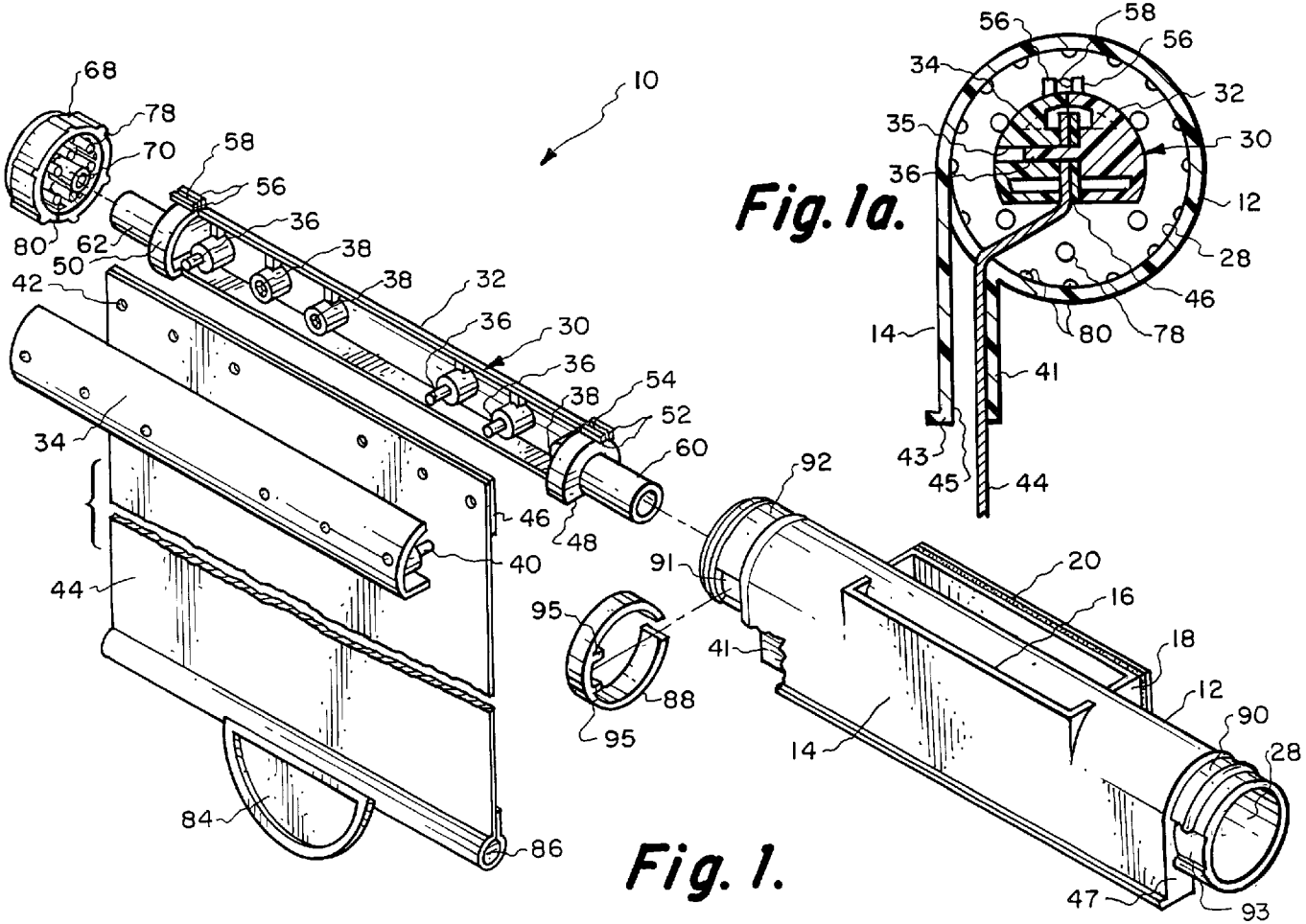
FIG. 1 is an exploded isometric view of the main embodiment of scroll advertising display device of the present invention showing the arrangement of the extendable sheet member relative to a spindle and the arrangement of the spindle relative to a housing.
FIG. 1*a* is a cross-sectional view through line 1*a*–1*a* of FIG. 3 showing in more detail the dispensing slot for the extendable sheet material member.
Figure 2:
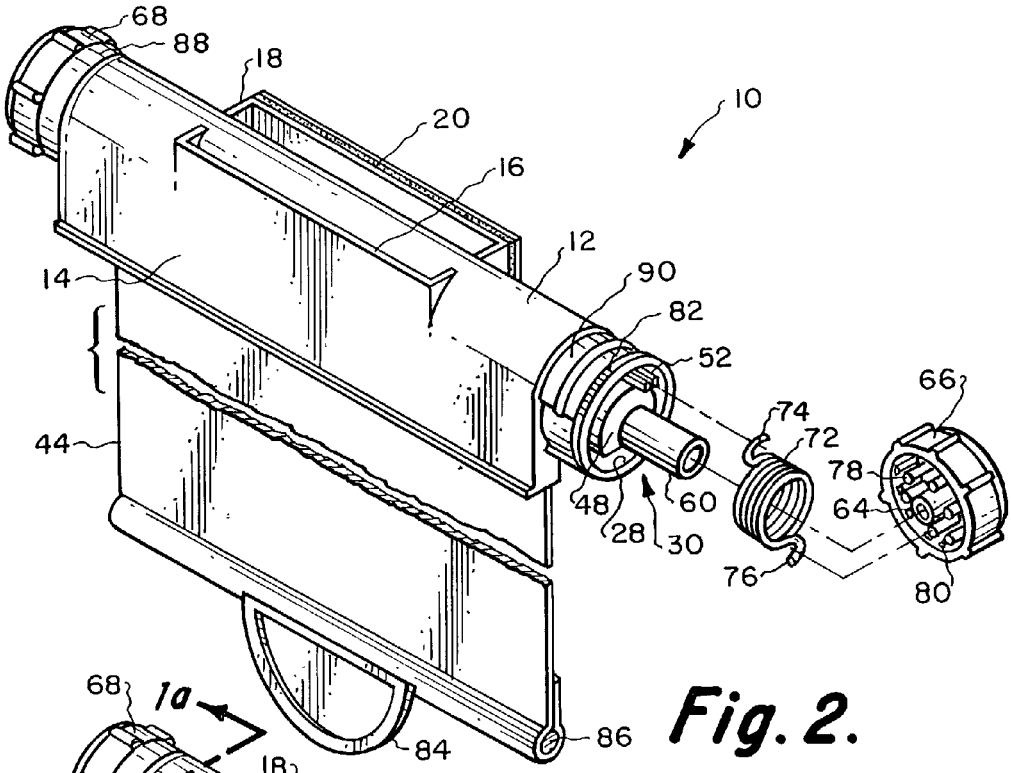
FIG. 2 is a partially exploded isometric view of the scroll advertising display device of the present invention showing in more detail the mounting arrangement between the housing and the spindle.
Figure 3:
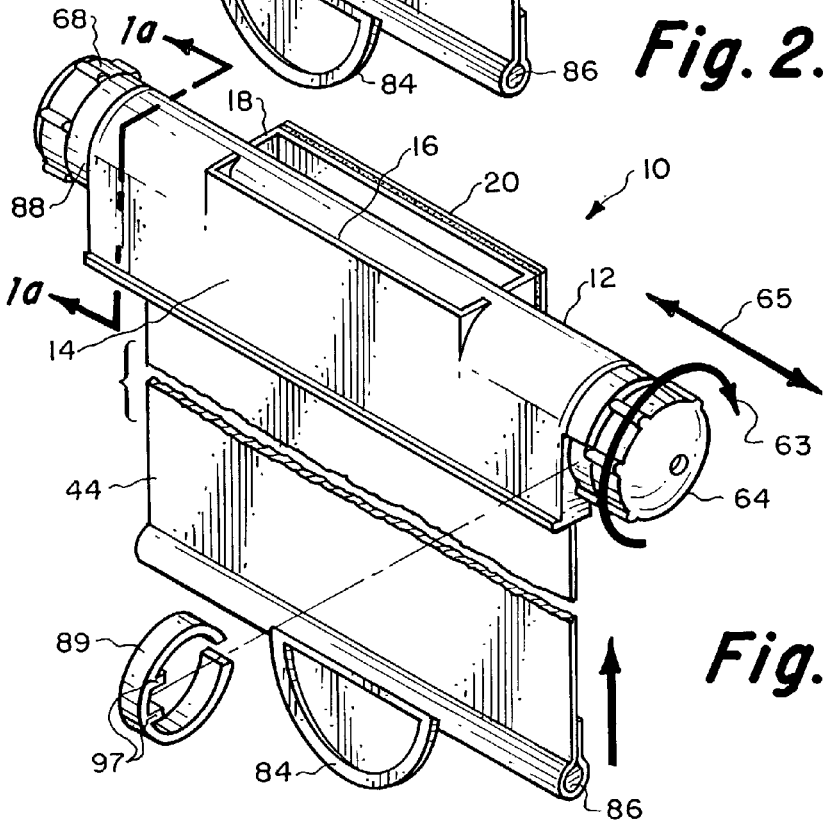
FIG. 3 is an isometric view similar to FIG. 2 but showing a locking ring which is utilized in conjunction with the housing in order to lock an end cap in a fixed position on the housing thereby establishing maintaining a desirable level of bias in conjunction with the spindle which will function to move an extendable sheet member to a retracted position.
Figure 4:
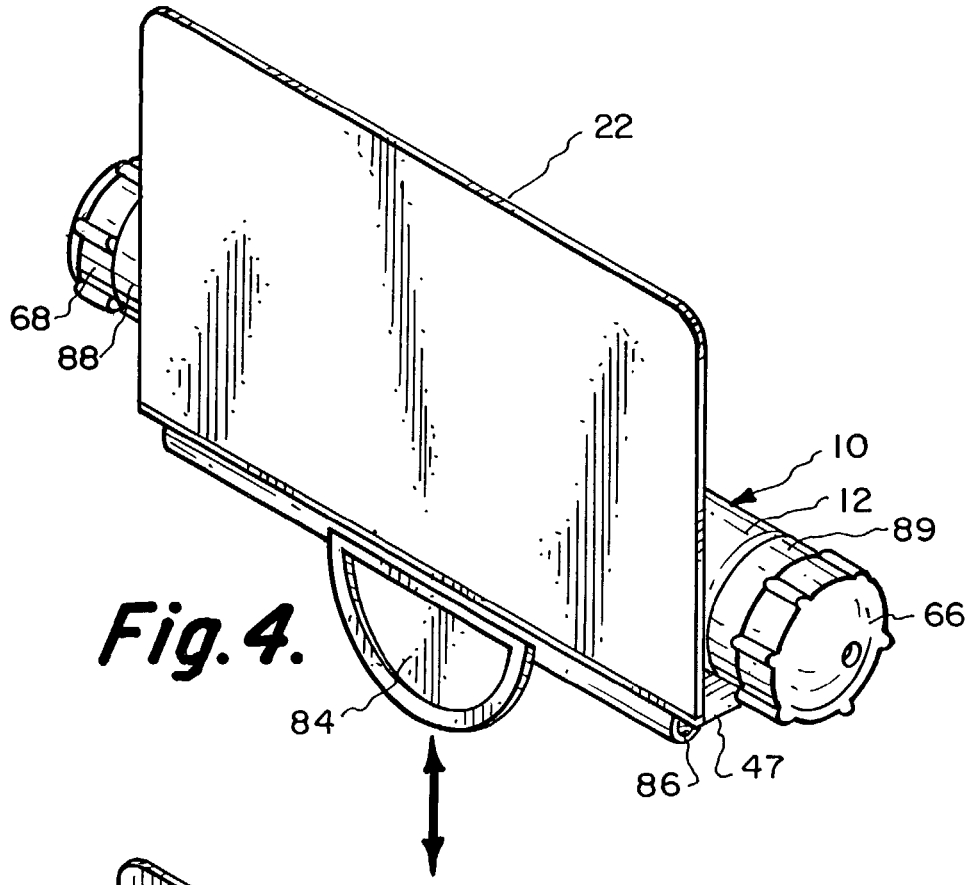
FIG. 4 is an isometric view of the scroll type of advertising device of the present invention showing the position of the advertising device as it would be installed on a conventional article supporting shelf within a store.
Figure 5:
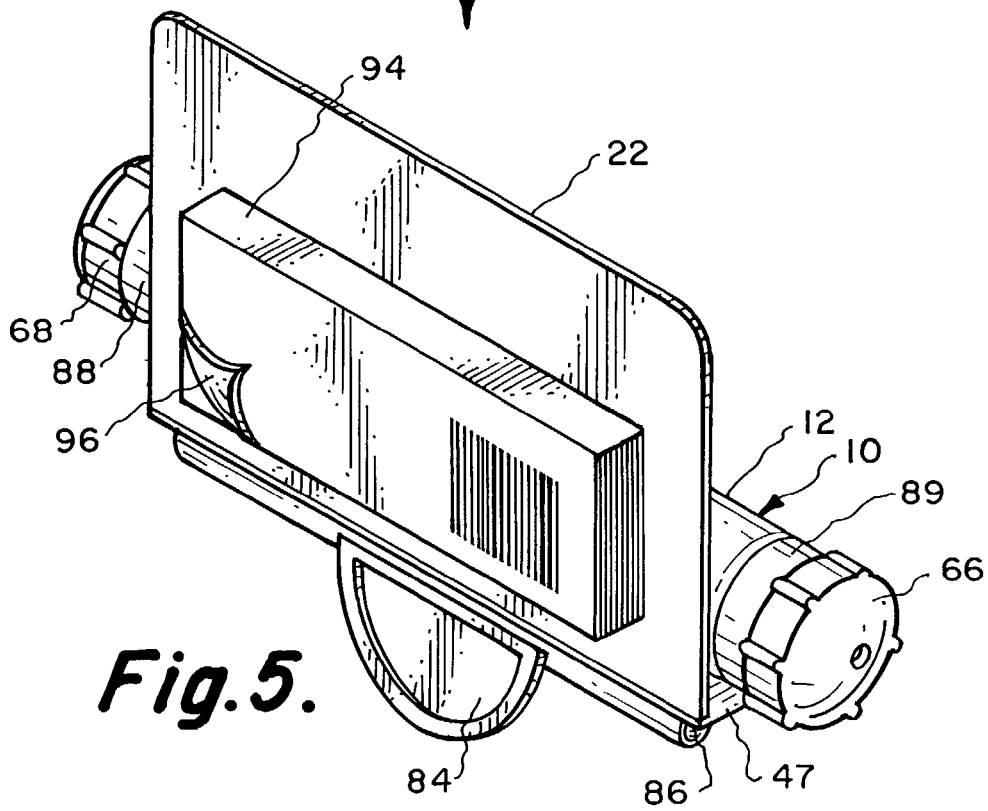
FIG. 5 is a view similar to FIG. 4 but shows a first form of material dispenser mounted in conjunction with the advertising display device.

Referring particularly to the drawing, there is shown in FIGS. 1–3 the main embodiment of scroll advertising display device 10 of this invention. The advertising display device 10 has a cylindrical housing 12. In exterior appearance, the cylindrical housing 12 has a flat face 14 which is formed partially on lineal protrusion 16. Lineal protrusion 16 is formed integral with the cylindrical housing 12. The reason lineal protrusion 16 is utilized is in order to maximize the flat area of flat face 14. Also integrally connected to the cylindrical housing 12 is an attaching flange 18 which has an exterior flat surface on which is mounted a section of double sided tape 20. The purpose of the double sided tape 20 is to facilitate attachment of the cylindrical housing 12 to an exterior structure, such as the front edge of a shelf. The flat face 14 can be used to fixedly secure thereto a plate, such as plate 22 in FIGS. 4–6, plate 24 in FIG. 7 and plate 26 in FIG. 8.

The cylindrical housing 12 is basically hollow and has an internal chamber 28. Mounted within the internal chamber 28 is a spindle 30. The spindle 30 has a cylindrical body which is constructed of part 32 and part 34. Mounted within the confines of part 32 are three in number of spaced apart protruding pins 36 and three in number of spaced apart sockets 38. Mounted on the inside surface of the part 34 is a similar series of protruding pins 40 and a similar series of sockets 35. A pin 36 is to align with a socket on part 34 and a pin 40 is to align with a socket 38. Each pin 40 is to matingly engage with a socket 38 and each pin 36 is to matingly engage with a socket 35. The parts 32 and 34 are then pressed tightly together with the pins 36 and 40 passing respectively through a hole 42 formed within a sheet member 44. There are six in number of the holes 42 all located at the inner end of the sheet member 44. This inner end of the sheet member 44 includes a reinforcing layer 46 which is mounted on the sheet member 44. The reinforcing layer 46 will normally comprise a thin layer of plastic. The function of the reinforcing layer 46 is to provide additional strength in the attachment between the sheet member 44 in conjunction with the spindle 30 in order to prevent tearing or breakage of the sheet member 44 during periods of extended use of the advertising display device 10 of this invention.

The part 32 terminates at each end in a collar 48 and a collar 50. Integrally mounted on the collar 48 are a pair of spaced apart narrow, identical, bar-like projections 52 which has a gap 54 formed therebetween. Similarly mounted on the collar 50 are a pair of similar projections 56 which form a gap 58 therebetween. Integrally mounted to the collar 48 and extending outwardly therefrom is a short extension of rod 60. A similar rod 62 is integral with the collar 50 and extends outwardly therefrom. Both of the rods 60 and 62 are integral and form a solid unit although such are hollow. Within previously referenced U.S. Pat. No. 6,038,800, the entire spindle, which was defined as a roller 42, was split in half forming two equal sized parts. It has been found to be undesirable to have the rods 60 and 62 to be split in half as over time such tend to separate slightly. The hollow interior of rod 60 is to accommodate protrusion 64 of an end cap 66, which is shown in FIG. 2 of the drawings. An end cap 68 has a protrusion 70 which is to be mounted within the hollow interior of the rod 62. As a result, the spindle 32 is journaled for rotative movement relative to end caps 66 and 68. If the rods 60 and 62 separate slightly, the rotation of the spindle 30 will not be free and smooth and the sheet member 44 will not retract fully. End cap 66 is to be snapped onto one end of the housing 12 with end cap 68 being snapped onto the opposite end of the housing 12. It is to be understood that there is a tight securement of part 32 to part 34 clamping therebetween the inner end of the sheet member 44.

The sheet member 44 and spindle 30 is then to be inserted into internal chamber 28. This is accomplished by sheet member 44 being conducted directly into lineal dispensing slot 45 which is open at one end and closed at the opposite end by wall 47. Dispensing slot 45 is formed between a front wall 43 and a rear wall 41 which are integral with housing 12. At the same time sheet member 44 is being slid into dispensing slot 45, the spindle 30 is being slid into internal chamber 28. The width of dispensing slot 45 is constant and approximately one-fourth of an inch.

A windup spring 72 is shown which is in the form of a coil spring. The windup spring 72 terminates at ends in the shape of hooks 74 and 76. The rod 60 is to be located within the center area of the windup spring 72 with the coils of the windup spring 72 being exteriorly mounted on the rod 60. Hook 74 is to be located in the gap 54. There could be used a similar windup spring in conjunction with rod 62 although normally it is preferred that a single windup spring is all that is required. If a second windup spring is used, that is why projections 56 are available. The hook 76 is to engage with one of the several thin rod protrusions 78 which is formed on the inside surface of the end cap 66. Mounted on the inside surface of the annular wall of the end cap 66 are a series of spaced apart teeth 80 which comprise a series of small bumps. Formed on the exterior surface of the housing 12 and directly adjacent the access opening into internal chamber 28 are a series of teeth 82. The end cap 66 can be moved linearly inward as indicated by arrow 65 a very slight distance which will disengage teeth 80 from teeth 82. This will permit the end cap 66 to be pivoted as indicated by arrow 63 to cause hook 76 to be pivoted as indicated by arrow 63 while hook 74 remains stationary. This will result in a bias being produced within the windup spring 72. When the desired amount of bias has been achieved, the user is to manually move the end cap 76 lineally in an outward direction again in direction of arrow 65 which will cause the teeth 80 and 82 to engage. This fixes the end cap 66 to the housing 12 maintaining the selected amount of bias of the windup spring 72. This bias within the windup spring 72 will be sufficient to just automatically fully retract the sheet member 44 to the retracted position against front wall 45 and rear wall 41, which is shown in FIGS. 4–8 of the drawings. Handle member 84 is attached to a cross bar 86. The outer end of the sheet member 44 is merely draped over the crossbar 86 and is secured with an adhesive. The handle member 84 is to protrude through an opening formed within the outer end of the sheet member 44.

Although there is shown an engaging connection between the end cap 66 and the housing 12, there may not be such an engaging connection between end cap 68 and housing 12. The end cap 68 may be just an idler type of end cap. Also, when the end cap 66 is located in position with teeth 80 and 82 engaged, it is desirable to insure that the end cap 66 remains in that position. For that purpose a plastic snap ring 89 is installed within a groove 90 formed within the housing 12. A similar snap ring 88 is area 14 for advertising indicia, the user can apply a plate 82 with an adhesive onto the flat area 14. The front surface of the plate 22 can be used for the placement of an additional written advertising indicia.

If the user wishes to dispense a pad 94 of coupons, recipes, entry forms or other similar written material, pad 94 can be adhesively secured onto the plate 22. The user is to be able to manually tear off top sheet 96 of the pad 94 and utilize that top sheet in the desired manner.

Figure 6:
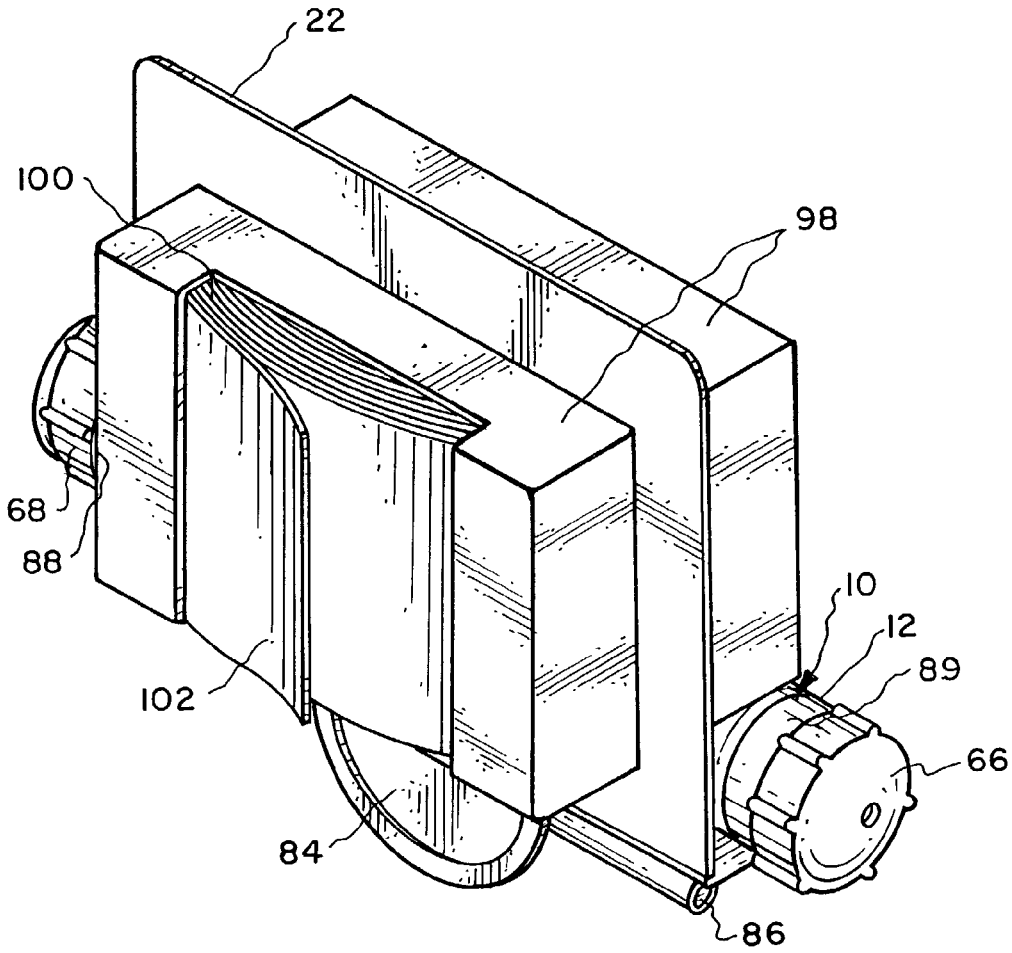
FIG. 6 is an isometric view of the advertising display device of the present invention showing a second form of material dispenser that is mounted in conjunction with the advertising display device.

Referring particularly to FIG. 6, there is shown a second form of coupon dispenser 98. The dispenser 98 is to include a quantity 100 of coupons with it being understood that the top coupon 102 can be manually removed from the quantity 100.

Figure 7:
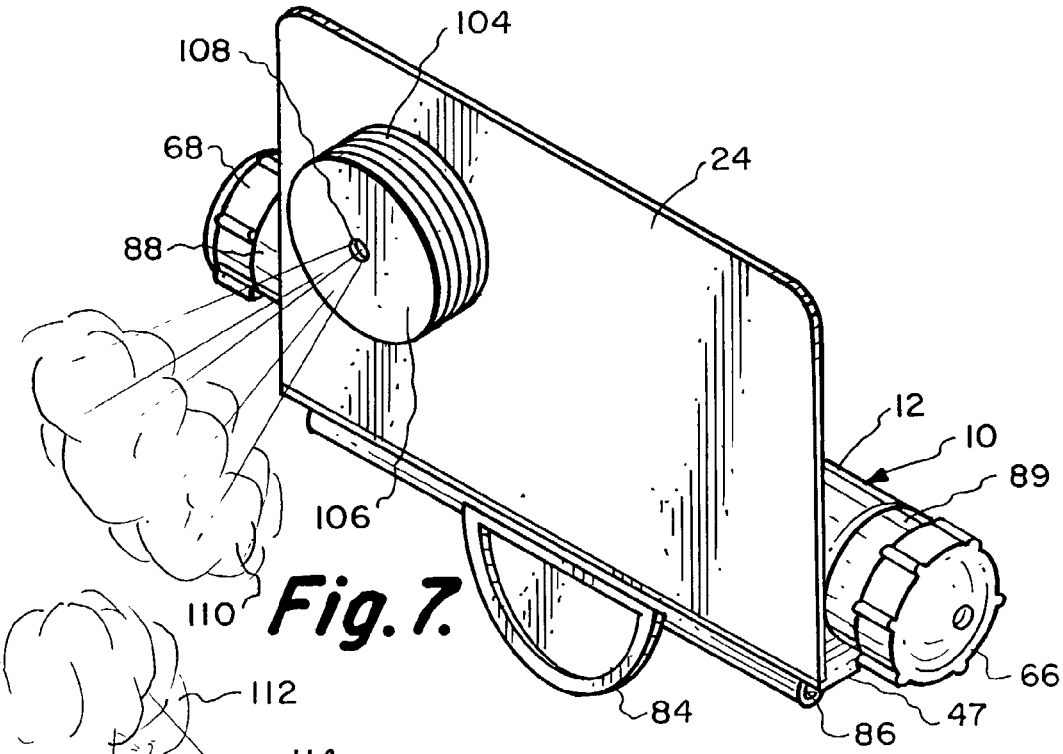
FIG. 7 is an isometric view of the advertising display device including a manually actuatable scent emitting dispenser mounted in conjunction with the display device.

Referring particularly to FIG. 7, the plate 24 has mounted thereon a push button dispenser 104. When the user pushes on the button 106, a small quantity of a scent 110 is to be emitted through the opening 108. The scent 108 will be a gaseous material. Typical dispensing of scents 110 would be a perfume or cologne. It is to be understood that manual activation of the push button 108 is by direct actuation by the consumer.

Figure 8:
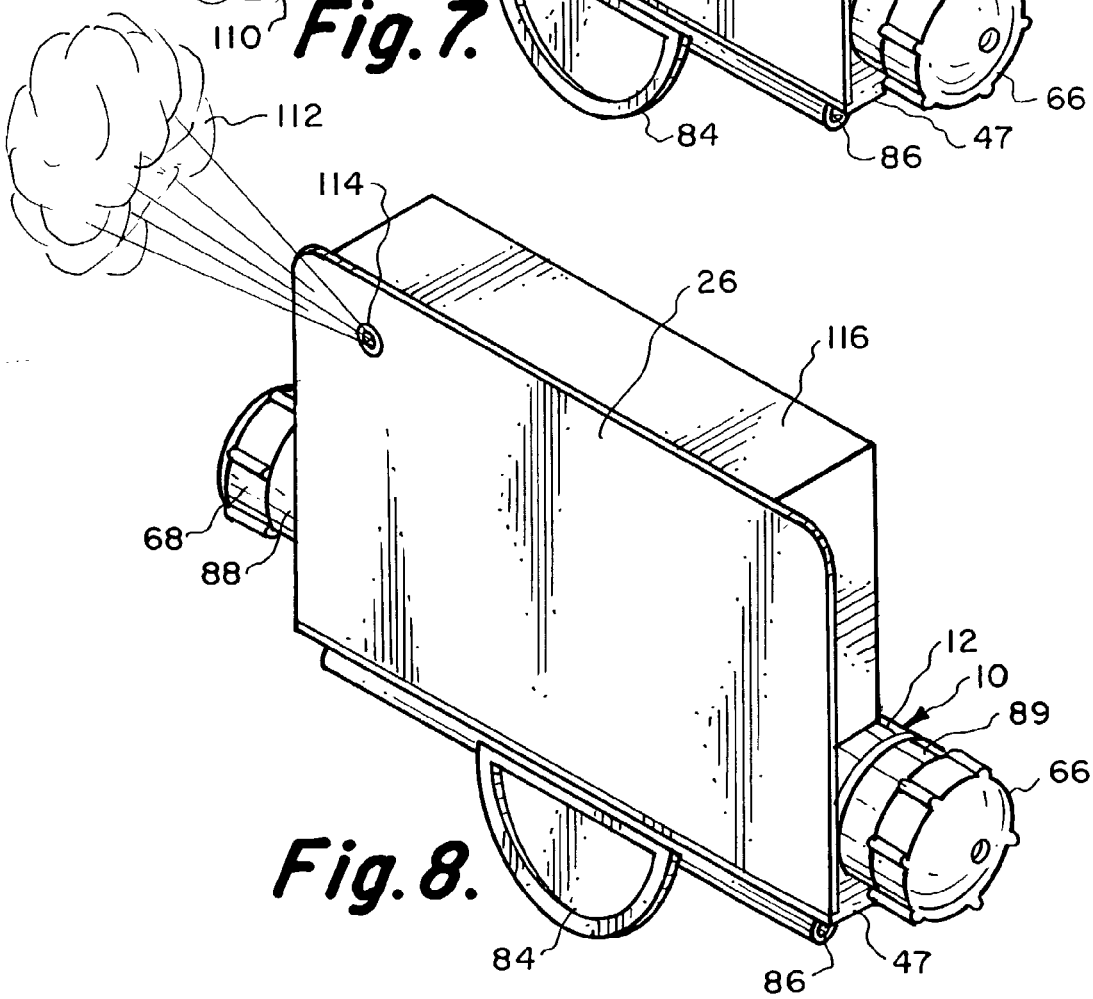
FIG. 8 is an isometric view similar to FIG. 7 but where the scent is emitted by means of extending of the sheet member rather than requiring direct manual activation of the scent dispenser.

Instead of the actuation by means of a push button, a scent 112 could be dispensed through an opening 114 formed within a plate 26 of FIG. 8. A storage quantity of the scent 112 could be contained within storage container 116 mounted on the back side of the plate 26 and resting on the cylindrical housing 12. It is to be understood that the scent 112 is dispensed each time the sheet member 44 is extended by pulling on the handle 84.

What is claimed is:

1. A scroll advertising display device comprising:

a housing having an internal chamber;

a spindle mounted within said internal chamber, a sheet member having an inner end and an outer end, said inner end being attached by connection means to said spindle, a pull handle mounted on the outer end;

a windup spring located within said internal chamber, whereby said sheet member is to be wound on said spindle compressing of said windup spring and exerting a bias onto said spindle tending to locate said sheet member in a tightly wound position with said handle located directly adjacent said housing, whereby said pull handle can be manually moved away from said housing causing extension of said sheet member exteriorly of said housing and upon release of said handle said bias of said windup spring will cause said sheet member to be rewound on said spindle; and said spindle having a first collar formed at one end thereof, a first pair of thin, rod-like projections located in a spaced apart arrangement mounted on said collar forming a gap therebetween, said windup spring terminating at one end in a hook, said hook being slid within said gap.

2. The scroll advertising display device as defined in claim 1 wherein:

said spindle having a second collar on which is mounted a second pair of projections located in a spaced apart arrangement forming a second gap therebetween, another said windup spring which has a hook to be connected to said second pair of projections by said hook being slid within said second gap.

3. The scroll advertising display device as defined in claim 1 wherein:

said inner end of said sheet member including a reinforcing member, said reinforcing member to provide additional strength to said sheet member to decrease the possibility of breaking of said sheet member relative to said spindle over a period of time of extended usage of said scroll advertising display device.

4. The scroll advertising display device as defined in claim 1 wherein:

a cap mounted on an end of said housing, said cap engaging with said windup spring, said cap being rotatable on said housing to produce an initial bias within said windup spring, said cap being movable to a locking position fixing said cap to said housing upon said initial bias being obtained.

5. The scroll advertising display device as defined in claim 4 wherein:

said cap being lineally movable in a lineal direction to said locking position.

6. The scroll advertising display device as defined in claim 5 wherein:

said housing having a longitudinal center axis, said lineal direction being parallel to said longitudinal center axis.

* * * * *